US006913514B2

(12) United States Patent
Kimura et al.

(10) Patent No.: US 6,913,514 B2
(45) Date of Patent: Jul. 5, 2005

(54) CHEMICAL MECHANICAL POLISHING ENDPOINT DETECTION SYSTEM AND METHOD

(75) Inventors: Norio Kimura, San Jose, CA (US); Huey-Ming Wang, Fremont, CA (US); Masayuki Kumekawa, San Jose, CA (US)

(73) Assignee: Ebara Technologies, Inc., Sacramento, CA (US)

( * ) Notice: Subject to any disclaimer, the term of this patent is extended or adjusted under 35 U.S.C. 154(b) by 108 days.

(21) Appl. No.: 10/602,034

(22) Filed: Jun. 23, 2003

(65) Prior Publication Data

US 2004/0192169 A1 Sep. 30, 2004

Related U.S. Application Data

(60) Provisional application No. 60/454,970, filed on Mar. 14, 2003.

(51) Int. Cl.[7] ..... B24B 49/12
(52) U.S. Cl. ..... 451/6; 451/533
(58) Field of Search ..... 451/6, 5, 41, 287, 451/288, 8, 533, 527, 530

(56) References Cited

U.S. PATENT DOCUMENTS 5,433,651 A 7/1995 Lustig et al.
5,486,129 A * 1/1996 Sandhu et al. ..... 451/5
6,068,539 A 5/2000 Bajaj et al.
6,106,662 A * 8/2000 Bibby et al. ..... 156/345.13
6,142,857 A * 11/2000 Cesna ..... 451/287
6,146,242 A * 11/2000 Treur et al. ..... 451/6
6,454,630 B1 * 9/2002 Tolles ..... 451/6
6,623,331 B2 * 9/2003 Sevilla et al. ..... 451/6

FOREIGN PATENT DOCUMENTS

JP 403234467 * 10/1991 ..... 451/6

* cited by examiner

*Primary Examiner*—Robert A. Rose
(74) *Attorney, Agent, or Firm*—Squire, Sanders & Dempsey; Aaron Wininger

(57) ABSTRACT

The system includes a polishing pad, a pad height sensor; a window; and a window raising mechanism. The polishing pad has an aperture with the window vertically moveable therein. The pad height sensor is positioned above the polishing pad and measures the vertical position of the pad before polishing. The window raising mechanism adjusts the vertical position of the window based on information from the pad height sensor. An endpoint measurement sensor can be disposed beneath the window for in-situ measurement of the polishing process.

21 Claims, 4 Drawing Sheets

CHEMICAL MECHANICAL POLISHING ENDPOINT DETECTION SYSTEM AND METHOD

PRIORITY REFERENCE TO PRIOR APPLICATIONS

This application claims benefit of and incorporates by reference patent application Ser. No. 60/454,970, entitled "End Point Detecting Device For CMP Applications," filed on Mar. 14, 2003, by inventors Norio Kimura, Huey-Ming Wang and Masayuki Kumekawa.

TECHNICAL FIELD

This invention relates generally to chemical mechanical polishing (CMP), and more particularly, but not exclusively, provides an endpoint detection system for a chemical mechanical polishing device with a movable window and a drainage system.

BACKGROUND

CMP is a combination of chemical reaction and mechanical buffing. A conventional CMP system includes a polishing head with a retaining ring that holds and rotates a wafer (also referred to interchangeably as a substrate) against a rotating polishing pad surface. The polishing pad can be made of cast and sliced polyurethane (or other polymers) with a filler or a urethane coated felt.

During rotation of the wafer against the polishing pad, a slurry of silica (and/or other abrasives) suspended in a mild etchant, such as potassium or ammonium hydroxide, is dispensed onto the polishing pad. The combination of chemical reaction from the slurry and mechanical buffing from the polishing pad removes vertical inconsistencies on the surface of the wafer, thereby forming an extremely flat surface.

During the CMP, a measurement sensor monitors the status of the CMP of the wafer in-situ by measuring the surface of the wafer through a window of the polishing pad. Once the measurement sensor determines that the CMP is complete, i.e., the endpoint has been reached, the CMP can stop.

However, the window can become optically degraded by the CMP and by pad conditioning, thereby degrading in-situ monitoring by the measurement sensor. For example, the pad conditioning can scratch the top surface of the window, which can lead to deflection of the laser from the measurement sensor during in-situ monitoring, therefore negatively affecting the monitoring.

To overcome this deficiency, traditional systems use movable windows that are lowered a predetermined distance during pad conditioning and raised the same distance during CMP. During CMP, traditional systems prefer to position the window at about or slightly below the polishing pad surface. However, since the pad wears down over time due to conditioning and polishing and since the window and pad wear down at different rates, the window will not always be raised to the same position relative to the polishing surface. In fact, it is likely to be raised above the height of the polishing pad surface, especially after many wafer polishings. Consequently, the window will interfere with CMP of the wafer and optically degrade, thereby causing wafer inconsistencies and less accurate measurements by the measurement system.

Accordingly, a new CMP endpoint detection system is needed that overcomes the above-mentioned deficiencies.

SUMMARY

The system includes a polishing pad, a pad height sensor; a window; and a window raising mechanism. The polishing pad has an aperture with the window vertically moveable therein. The pad height sensor is positioned above the polishing pad and measures the vertical position of the pad before polishing. The window raising mechanism adjusts the vertical position of the window based on information from the pad height sensor.

The method comprises determining a vertical position of a top surface of a polishing pad in a chemical mechanical polishing system; positioning a window disposed in an aperture of the polishing pad such that the top surface of the window is at about the same vertical position of the top surface of the pad based on the determination; and then polishing a wafer.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DETAILED DESCRIPTION OF THE ILLUSTRATED EMBODIMENTS

The following description is provided to enable any person having ordinary skill in the art to make and use the invention, and is provided in the context of a particular application and its requirements. Various modifications to the embodiments will be readily apparent to those skilled in the art, and the principles defined herein may be applied to other embodiments and applications without departing from the spirit and scope of the invention. Thus, the present invention is not intended to be limited to the embodiments shown, but is to be accorded the widest scope consistent with the principles, features and teachings disclosed herein.

Figure 1:
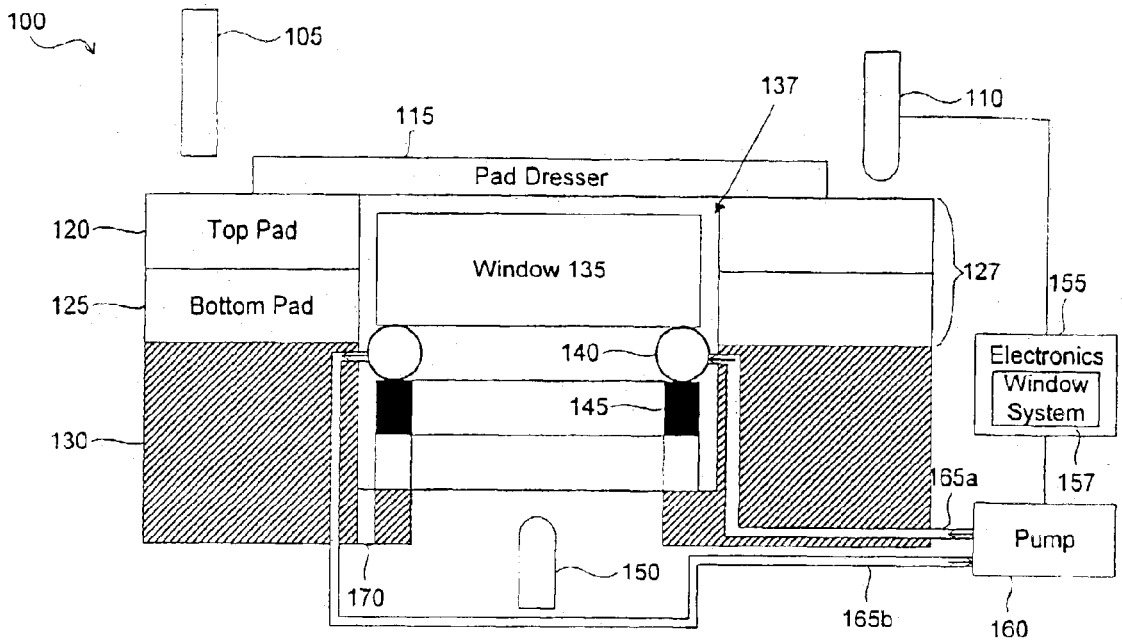
FIG. 1 is a cross section illustrating a CMP system with a window in a lowered position according to an embodiment of the invention.

FIG. 1 is a cross section illustrating a CMP system 100 with a window 135 in a lowered position according to an embodiment of the invention. The CMP system 100 comprises a polishing pad 127 comprising a top pad 120 and bottom pad 125; a platen or turntable 130; a drain 170; a measurement sensor 150; a slurry dispenser 105; a pad height sensor 110; electronics 155housing a window system 157; a pump 160; pump tubing 165*a* and 165*b*; a seal 145; and a toroid 140 (or other shape of inflatable member).

The polishing pad 127 rests on top of the platen 130, which rotates. The slurry dispenser 105 is located above the top pad 120 so that it can dispense slurry onto the top pad 120 during CMP. The window 135 is located in an aperture 137 of the polishing pad 127 and rests on the toroid 140, which is capable of expanding and contracting to raise and lower the window 135, respectively. The toroid 140 is in fluid (including any fluid which is moveable such as liquid or gas) communication with the pump 160 via tubes 165*a* and 165*b* and is positioned so that the sensor 150 has an unobstructed view of the wafer 200. To raise the window 135, the pump 160 pumps fluid into the toroid 140 via the tubing 165*a*, thereby inflating or expanding the toroid 140. Excess fluid flows out of the toroid 140 via the tubing 165*b* perhaps to maintain constant pressure. To lower the window 135, the pump 160 ceases pumping or decreases the rate of pumping fluid to the toroid 140 or opens the tubing 165*b*. In an embodiment of the invention, the pump 160 is fixed to the platen 130 and therefore rotates with the platen 130 thereby preventing the tubing 165*a* and 165 from becoming entangled during CMP or pad conditioning/dressing.

The window 135 can have an area of about 0.04 $mm^2$ to 100 $cm^2$; a thickness of about 0.002 to about 0.1 inches; a hardness of about 25 Shore A to about 75 Shore D; and a high optical transmission for ultraviolet (UV), infrared (IR) light, lasers and observable light. Further, the window 135 can be coated with a slurry-phobic material, such as silicone, lyophilic or hydrophobic materials. The seal 145 is coupled to the toroid 140 and prevents excess slurry or other waste products from touching the underside of the window 135, which may optically degrade it or otherwise interfere with the measurement sensor 150. It will be appreciated that the window 135 is not integrated into the pad 127 as in conventional systems but is coupled to the platen 130, in this example, via the toroid 140 and the seal 145.

The electronics 155 includes a window system 157, which will be discussed in further detail in conjunction with FIG. 5. The electronics 155 is communicatively coupled to the pump 160 and the pad height sensor 110 and controls the vertical positioning of the window 135 based on data received from the pad height sensor 110 by adjusting the rate that the pump 160 pumps fluid into the toroid 140. The pad height sensor 110 is positioned above the top pad 120 and includes any sort of distance measuring sensor, such as a laser sensor or eddy current sensor. The sensor 110 feeds distance data (to recognize pad wear) to the electronics 155, which in turn calculates how fast or at what pressure to run the pump 160 to raise the window 135 to the current height of the top pad 120. Accordingly, the CMP system 100 enables positioning of the window 135 to be flush with or slightly below the top surface of the top pad 120 even though the height of the top pad 120 decreases with each wafer polishing and/or conditioning. In addition, the pad height sensor 110 enables finer measurements, compared to manual measurements, thereby enabling more accurate vertical positioning of the window 135.

The measurement sensor 150 is located below the window 135 and faces the wafer 200. The sensor 150 is used for in-situ monitoring of the CMP process and determines the endpoint of the CMP process by analyzing radiation reflected off of the wafer 200 through the window 135. An example of a measurement sensor is disclosed in U.S. Pat. No. 5,433,651. However, one skilled in the art will recognize that any optical measurement system can be used.

In addition, the CMP system 100 includes a drain 170 located in the base of the aperture 137 that collects excess slurry and/or other waste products from pad conditioning or CMP that enters the aperture 137 and then transports it to a drainage system (not shown) of the CMP system 100 for disposal. Other waste may include deionized (DI) water and wafer debris. Accordingly, the drain 170 prevents buildup of slurry and other materials in the aperture 137 or along the top of the window 135.

Figure 2:
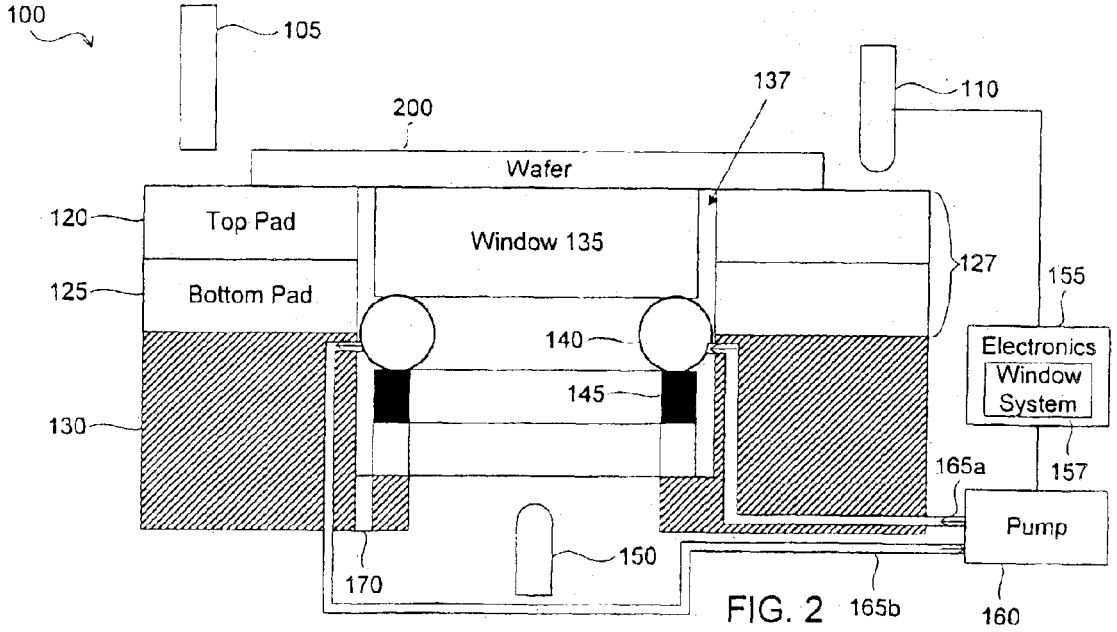
FIG. 2 is a cross section illustrating the CMP system of FIG. 1 with the window in a raised position.

During pad conditioning (also referred to as dressing), the window 135 may be lowered as shown in FIG. 1, to prevent optically degrading the window 135 (e.g., scratching the window 135). During wafer polishing, as shown in FIG. 2, the window 135 may be raised to be flush with the top surface of the top pad 120. The electronics 155, using data from the pad height sensor 110, determines the height of the top pad 120 and raises the window 135 to the approximate height to prevent the window 135 from negatively affecting the polishing of a wafer 200 or from being degraded itself.

Figure 3:
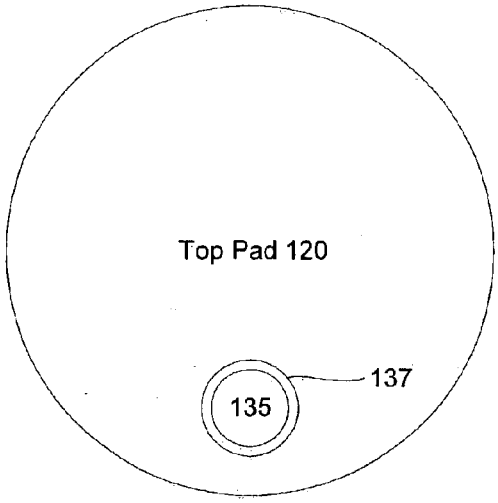
FIG. 3 is a top view illustrating a top pad of the polishing pad used in the CMP system of FIG. 1.

FIG. 3 is a top view illustrating the top pad 120 of the polishing pad 127 used in the CMP system 100 (FIG. 1). In an embodiment of the invention, the top pad 120 is circular and includes the circular aperture 137. The window 135 is located within the aperture 137 and is also circular. In another embodiment of the invention, the aperture 137 and/or the window 135 can comprise other shapes such as a triangle, rectangle, square, oval, polygon or other shape. In addition, the polishing pad 127 can include a plurality of apertures 137 with windows 135 disposed therein. Further, the shape of the window 135 need not be the same as the shape of the aperture 137.

Figure 4:
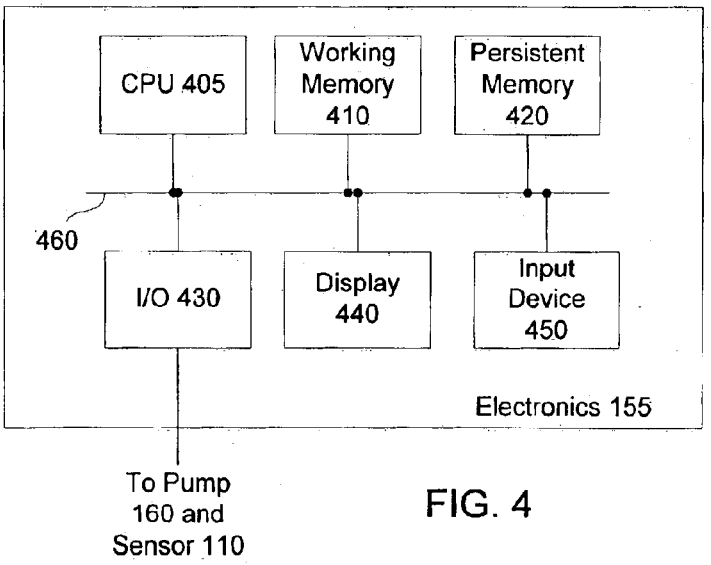
FIG. 4 is a block diagram illustrating the electronics of the CMP system of FIG. 1.

FIG. 4 is a block diagram illustrating the electronics 155. The electronics 155, using the window system 157 that resides therein, controls the height of the window 135 via control of the pump 160 in response to data received from the pad height sensor 110. The electronics 155 includes a central processing unit (CPU) 405; working memory 410; persistent memory 420; input/output (I/O) interface 430; display 440 and input device 450, all communicatively coupled to each other via a bus 460. The CPU 405 may include an Intel Pentium® microprocessor, a Motorola PowerPC® microprocessor, or any other processor capable to execute software stored in the working memory 110 and/or the persistent memory 420. The working memory 410 may include random access memory (RAM) or any other type of read/write memory devices or combination of memory devices. The persistent memory 420 may include a hard drive, read only memory (ROM) or any other type of memory device or combination of memory devices that can retain data after the electronics 155 is powered down. The I/O interface 430 is communicatively coupled; via wired or wireless techniques, to the pad height sensor 110 and the pump 160. The display 440, like other components of the electronics 155, is optional and may include a cathode ray tube display or other display device. The input device 450, which is also optional, may include a keyboard, mouse, or other device for inputting data, or a combination of devices for inputting data.

One skilled in the art will recognize that the electronics 155 may also include additional devices, such as network connections, additional memory, additional processors, LANs, input/output lines for transferring information across a hardware channel, the Internet or an intranet, etc. One skilled in the art will also recognize that the programs and data may be received by and stored in the system in alternative ways. Further, in an embodiment of the invention, an ASIC is used in placed of the electronics 155 to receive data from the pad height sensor 110 and to control the pump 160.

Figure 5:
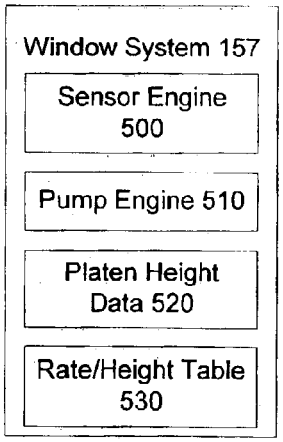
FIG. 5 is a block diagram illustrating the window system of FIG. 1.

FIG. 5 is a block diagram illustrating the window system 157. The window system 157 includes a sensor engine 500, a pump engine 510, platen height data 520, and a pressure/height table 530. The sensor engine 500 controls the pad height sensor 110 and instructs the pad height sensor 110 to determine the distance between itself and the top of the polishing pad 127, which potentially increases after each wafer 200 processing cycle. The sensor engine 500 receives the distance measurement made by the sensor 110 and relays this data to the pump engine 510. The sensor 110 readings can be done before initiating each wafer 200 CMP or after a set number of CMPs, depending on the sensitivity of the sensor 110 and the amount of pad wear per CMP cycle.

The pump engine 510, based on the distance measurement data received from the sensor engine 500 and data in the rate/height table 530, increases or decreases the rate of pumping by the pump 160 to inflate or deflate the toroid 140, thereby raising or lowering the window 135 to be flush with or slightly lower than the height of the pad 127. In the instant example, the pump engine 510 determines the rate to run the pump 160 by first calculating the height of the pad 127 by subtracting the received distance measurement from the distance between the sensor 110 and the platen 130, as stored in the platen height data 520. The pump engine 510 then looks up the rate corresponding to the calculated height in the rate/height table 530. The pump engine 510 also instructs the pump 160 to deflate the toroid 140, thereby lowering the window, during pad conditioning. Alternatively, the pump 160 can include a pressure sensor which indicates the proper amount of pressure in the toroid 140 based on a pressure/height table (not shown).

The platen height data 520 stores the distance between the sensor 110 and the top of the platen 130 when the pad 127 is not mounted on the platen 130. The distance can be input by an operator or measured by the sensor 110. The rate/height table 530 stores heights of the pad 127 and corresponding pump 160 rates that will position the window 135 to the current height of or just below the current height of the pad 127. The data in the table 530 can be entered based on empirical data—that is, by running the pump at various rates and measuring how high the window 135 is raised. It will be appreciated by one of ordinary skill in the art that the data stored in the table 530 can be stored in other types of data structures and that the use of a table is for the sake of simplicity and clarity.

It will be appreciated by one of ordinary skill in the art that the window system 157 can be adapted for use with any window-raising mechanism.

Figure 6:
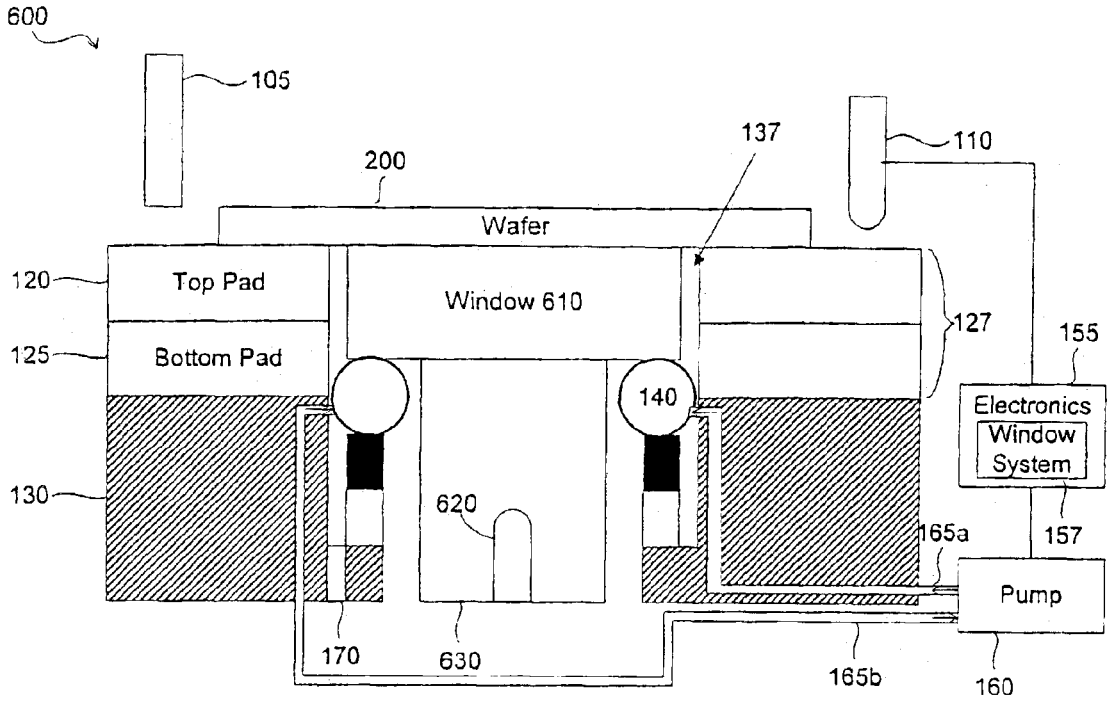
FIG. 6 is a cross section illustrating a CMP system according to a second embodiment of the invention.

FIG. 6 is a cross section illustrating a CMP system 600 according to a second embodiment of the invention. The CMP system 600 is substantially similar to the CMP system 100 except that a measurement sensor 620 is fixedly coupled to a window 610 within a housing 630. Accordingly, vertical movement of the window 610 will also vertically move the housing 630 and therefore will vertically move the measurement sensor 620. This may be advantageous, as the measurement sensor 620 would not have to compensate for movement of the window 610.

The CMP system 600 operates in a manner substantially similar to the operation of the CMP system 100. During pad conditioning, the pump 160, based on control signals from the electronics 155, reduces its pump rate to the toroid 140. Accordingly, the window 610 is lowered below the height of the pad 127, thereby preventing it from getting scratched or otherwise optically degraded by the pad dresser 115. During wafer 200 polishing, the electronics 155 increases the pump 160 rate to inflate the toroid 140, thereby raising the window 610 to the height of the polishing pad 127. Since the window 610 is coupled to the housing 630, the sensor 620 will also rise in conjunction with the raising of the window 610.

In addition, during polishing and pad conditioning, excess slurry and/or waste products enter the aperture 137 and exit through the drain 170, thereby preventing buildup of materials on the window 610 or within the aperture 137. During polishing, the sensor 620 is used for in-situ monitoring of the CMP process and determines the endpoint of the CMP process by analyzing radiation reflected off of the wafer 200 through the window 135.

Figure 7:
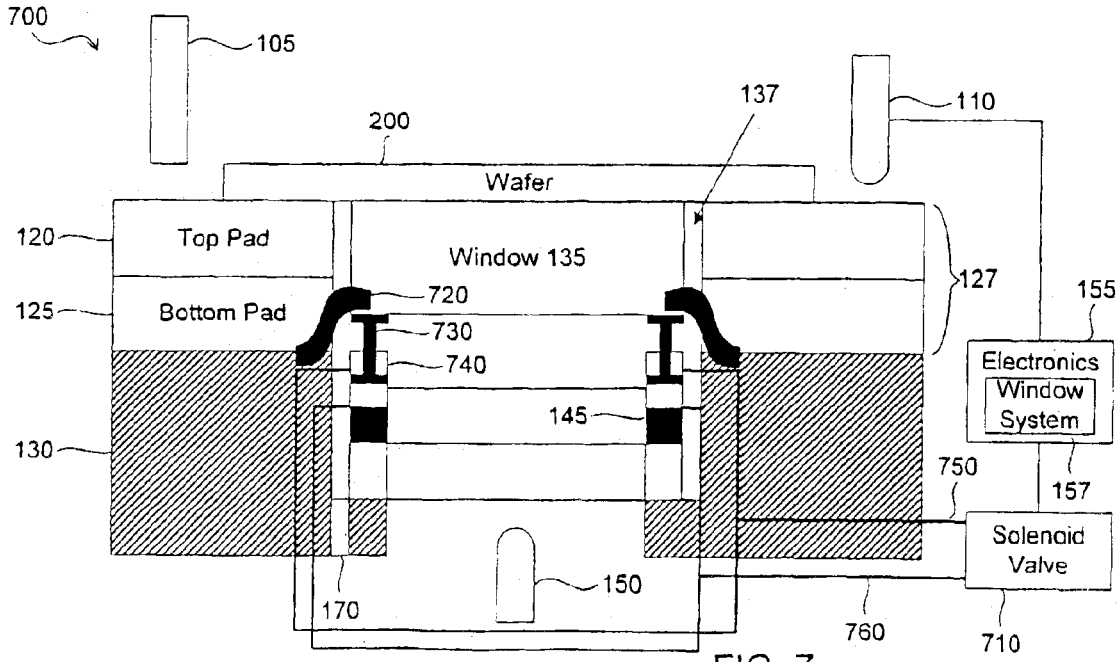
FIG. 7 is a cross section illustrating a CMP system according to a third embodiment of the invention.

FIG. 7 is a cross section illustrating a CMP system 700 according to a third embodiment of the invention. The CMP system 700 is substantially similar to the CMP system 100 except that it includes a solenoid valve 710 in place of the pump 160 and a plurality of cylinders 730 in place of the toroid 140. In an embodiment of the invention, the plurality of cylinders 730 includes at least three cylinders 730. The cylinders 730 are positioned at location on the bottom of the window 135 so as to provide the sensor 150 with an unobstructed view of the wafer 200. The system 700 may also include flexible diaphragms 720 coupled between the window 135 and the platen 130. The diaphragms 720 assist in the smooth vertical movement of the window 135 and prevent horizontal movement of the window 135. In this embodiment, the electronics 155 is communicatively coupled to the solenoid valve 710 in place of the pump 160. The solenoid valve 710 is in turn coupled to the plurality of cylinders 730, which are fixed to the bottom of the window 135.

The electronics 155, using the window system 157, control the vertical location of the window 135 by controlling the solenoid valve 710, which in turn controls the vertical movement of the cylinders 730. The cylinders 730 are disposed within chambers 740 that are in fluid communication with the solenoid valve 710 via tubes 750 and 760. The chambers 740 are each divided into a top and bottom section by the cylinders 730 disposed therein. Fluid can travel between the top and bottom sections via the tubes 750 and 760 through the solenoid valve 710. The tube 750 is connected to the top section of each chamber 740 while the tube 760 is connected to the bottom section of each chamber 740. Increasing the pressure in the lower section of each chamber 740 and decreasing the pressure in the top section of each chamber 740 raises the cylinders 730, thereby raising the window 135. Conversely, lowering the pressure in the lower section of each chamber 740 and increasing the pressure in the top section of each chamber 740 lowers the cylinders 730, thereby lowering the window 135.

The pad height sensor 110 is positioned above the top pad 120 and includes any sort of distance measuring sensor, such as a laser sensor or eddy current sensor. The sensor 110 feeds distance data corresponding to pad wear to the electronics 155, which in turn calculates the distribution of pressure within the chambers 740 required to raise the window 135 to the current height of the top pad 120. Accordingly, the CMP system 700 enables positioning of the window 135 to be flush with or slightly below the top surface of the top pad 120 even though the height of the top pad 120 decreases with each wafer polishing and/or conditioning.

The window system 157 is adapted to work with the window-raising mechanism of the CMP system 700, i.e., the solenoid valve 710 coupled to the cylinders 730. As such, the pump engine 510 controls the solenoid valve 710 based on data in the rate/height table 530 which includes pressures for the chambers 740 necessary to raise the window 135 to specific heights.

During operation of the CMP system 700, the electronics 155 send a signal to the solenoid valve 710 to adjust pressure in the chambers 740, thereby raising or lowering the cylinders 730. For example, during pad 127 conditioning, the electronics 155 instructs the solenoid valve 710 to adjust pressure within the chambers 740 to lower the window 135 below the height of the pad 127. For wafer 200 polishing, the electronics 155 instructs the solenoid valve 710 to adjust and maintain the pressure within the chambers 740 so that the top surface of the window 135 is flush with the top of the top pad 120 or slightly below the top of the top pad 120. During CMP, the measurement sensor 150 measures the CMP process in-situ and determines the endpoint according to conventional techniques. Excess slurry and/or waste products enter the aperture 137 and exit the CMP system 700 via the drain 170.

Figure 8:
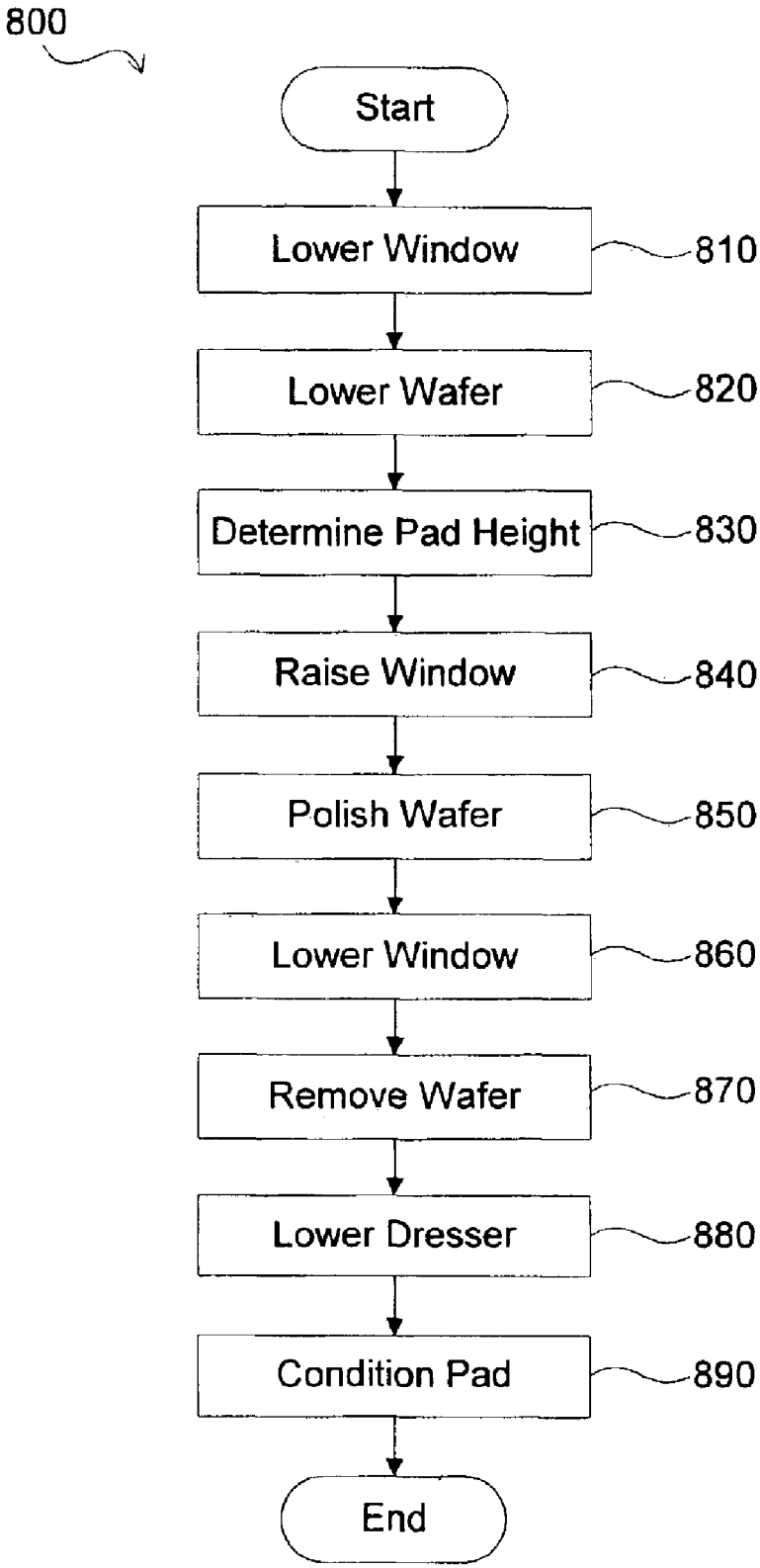
FIG. 8 is a flowchart illustrating a method of performing CMP.

FIG. 8 is a flowchart illustrating a method 800 of performing CMP and pad dressing. The CMP systems 100, 600 or 700 can implement the method 800. First, CMP is performed. The window, e.g., the window 135, is lowered (810) and then the wafer 200, mounted in a polishing head, is lowered (820) to contact the polishing pad 127. The height of the polishing pad 127 is then determined (830) based on a distance measurement made with a sensor mounted above the pad 127, such as the sensor 110. In an embodiment, the actual pad 127 height is determined by subtracting the distance measurement from a known distance between the sensor 110 and the platen 130. The window is then raised (840) to height of the top of the polishing pad 127 or slightly below the height. The wafer 200 is then polished (850), i.e., CMP is performed. During the polishing (850), excess slurry and/or waste products are drained from CMP system via the drain 170. The polishing (850) is stopped once the measurement sensor 150 or 620 determines that the endpoint has been reached.

After the wafer 200 is polished (850), pad dressing or conditioning can be performed. The conditioning includes lowering (860) the window 135; removing the wafer (870) from the CMP system; lowering the dresser 115 (880); and then conditioning (890) or dressing the pad 127. During the condition (890) any waste products are drained via the drain 170. The method 800 then ends.

One of ordinary skill in the art will recognize that the method 800 can be performed in orders other than that described above. For example, the pad conditioning can occur before the wafer polishing. In addition, other methods than that disclosed can be used to determine (830) the pad height. Further, the pad height determination (830) can be performed at different times in the method 800.

The foregoing description of the illustrated embodiments of the present invention is by way of example only, and other variations and modifications of the above-described embodiments and methods are possible in light of the foregoing teaching. For example, other mechanisms can be used to vertically position the window 135 besides those described herein. Further, components of the electronics 155 may be implemented using a programmed general purpose digital computer, using application specific integrated circuits, or using a network of interconnected conventional components and circuits. Connections may be wired, wireless, modem, etc. The embodiments described herein are not intended to be exhaustive or limiting. The present invention is limited only by the following claims.

What is claimed is:

1. A chemical mechanical polishing method, comprising:

determining a vertical position of a top surface of a polishing pad in a chemical mechanical polishing system using a pad height sensor by determining a distance between the pad height sensor positioned above the polishing pad and the polishing pad, and subtracting the determined distance from a known distance between the pad height sensor and a surface on which the polishing pad rests;

positioning a window disposed in an aperture of the polishing pad such that the top surface of the window is at about the same vertical position of the top surface of the pad based on the determination; and polishing a wafer.

2. The method of claim 1, further comprising:

determining an endpoint of the polishing; and stopping the polishing upon reaching the endpoint.

3. The method of claim 1, further comprising draining slurry and waste product from the aperture.

4. The method of claim 1, further comprising:

lowering the window; and conditioning the pad after lowering the window.

5. The method of claim 1, wherein the window is coated with a slurry-phobic substance.

6. The method of claim 1, further comprising:

positioning additional windows disposed in apertures of the polishing pad such that the top surface of each window is at about same vertical position of the top surface of the pad.

7. A CMP system, comprising:

a polishing pad having an aperture;

a pad height sensor positioned above the polishing pad;

a window vertically moveable within the aperture; and a window raising mechanism capable of adjusting the vertical position of the window based on information from the pad height sensor.

8. The system of claim 7, further comprising an endpoint measurement sensor positioned beneath the window.

9. The system of claim 7, further comprising a drain disposed in the aperture.

10. The system of claim 7, further comprising a pad dresser.

11. The system of claim 7, wherein the window is coated with a slurry-phobic substance.

12. The system of claim 7, further comprising additional windows, each window disposed in an additional aperture of the polishing pad, and wherein each window is movable between a lowered position and raised position at about the height of the polishing pad as determined by the pad height sensor.

13. The system of claim 7, wherein the window rests on an inflatable toroid coupled to a pump.

14. The system of claim 7, wherein the window rests on a plurality of cylinders, each partially disposed in an airtight chamber coupled to a solenoid valve.

15. A CMP system, comprising:

means for determining a vertical position of a top surface of a polishing pad in a chemical mechanical polishing system;

means for positioning a window disposed in an aperture of the polishing pad such that the top surface of the window is at about the same vertical position of the top surface of the pad based on feedback from the means for determining and means for polishing a wafer.

16. A CMP control system, comprising:

a rate/height data structure holding data indicating the relationship between the vertical position of a window disposed within an aperture of a polishing pad and control data for a window-raising mechanism;

a sensor engine capable of receiving distance data from a pad height sensor positioned above the polishing pad;

a pump engine, communicatively coupled to the sensor engine and the data structure, capable of sending commands to the window-raising mechanism based on control data related to the received distance data, to raise the window to about the height of the polishing pad.

17. The system of claim 16, wherein the window raising mechanism is a pump coupled to an inflatable toroid.

18. The system of claim 16, wherein the window raising mechanism is a solenoid valve coupled to a plurality of chambers having cylinders disposed therein.

19. A computer-readable medium having stored thereon instructions to cause a computer to execute a method, the method comprising:

receiving distance data from a pad height sensor positioned above a polishing pad;

calculating a height of the polishing pad based on the received distance data; and transmitting an instruction to a window-raising mechanism based on the calculation that will the raise a window disposed within an aperture of a polishing pad to about the calculated height of the polishing pad.

20. The computer-readable medium of claim 19, wherein the window raising mechanism is a pump coupled to an inflatable toroid.

21. The computer-readable medium of claim 19, wherein the window raising mechanism is a solenoid valve coupled to a plurality of chambers having cylinders disposed therein.

* * * * *